US009813796B1

(12) United States Patent
Deng

(10) Patent No.: US 9,813,796 B1
(45) Date of Patent: Nov. 7, 2017

(54) WATERPROOF BLUETOOTH DUAL-EARPHONE POWER BANK

(71) Applicant: SHENZHEN XIWXI TECHNOLOGY CO., LIMITED, Shenzhen (CN)

(72) Inventor: Xiuhong Deng, Shenzhen (CN)

( * ) Notice: Subject to any disclaimer, the term of this patent is extended or adjusted under 35 U.S.C. 154(b) by 0 days.

(21) Appl. No.: 15/586,272

(22) Filed: May 4, 2017

(51) Int. Cl.
*H04R 1/10* (2006.01)

(52) U.S. Cl.
CPC ..... *H04R 1/1025* (2013.01); *H04R 1/1016* (2013.01); *H04R 1/1058* (2013.01); *H04R 1/1091* (2013.01); *H04R 2420/07* (2013.01)

(58) Field of Classification Search
CPC . H04R 1/1025; H04R 1/1016; H04R 2420/09
USPC ..... 381/74
See application file for complete search history.

(56) References Cited

U.S. PATENT DOCUMENTS 6,519,448 B1 * 2/2003 Dress ..... H03J 1/0091 381/311
7,272,421 B2 * 9/2007 Bang ..... H02J 7/0044 379/441
7,844,311 B2 * 11/2010 Kim ..... H04M 1/03 379/420.01
8,489,151 B2 * 7/2013 Van Engelen ..... H04M 1/6033 379/433.02
2008/0280561 A1 * 11/2008 Lin ..... H04M 1/05 455/41.2

* cited by examiner

*Primary Examiner* — Disler Paul
(74) *Attorney, Agent, or Firm* — Prakash Nama; Global IP Services, PLLC

(57) ABSTRACT

The utility model discloses a waterproof Bluetooth dual-earphone power bank, comprising a mobile power supply body and a Bluetooth dual-earphone component connected with the mobile power supply body, wherein the mobile power supply body and the Bluetooth dual-earphone component are both sealed structures. The power bank of the utility model is fastened up and down through two sealing rings such that an inner housing is sealed and bonded with an upper cover and that a rubber pad is sealed and bonded with a base, thus fulfilling the waterproofing purpose by extruding the sealing rings. The power bank of the utility model achieves a stable and reliable waterproof effect and ensures stable charging and service life of the product. The power bank of the utility model is wrapped with a metal housing outside, achieving anti-collision and anti-scratching effects; and the hand feel is strengthened through surface sanding and oxidation treatment.

8 Claims, 4 Drawing Sheets

WATERPROOF BLUETOOTH DUAL-EARPHONE POWER BANK

BACKGROUND OF THE INVENTION

The utility model relates to an electronic product, specifically to a waterproof Bluetooth dual-earphone power bank.

A power bank is a mobile power supply.

Common and conventional Bluetooth earphone power banks do not have features of waterproofing and seepage resistance, and usually cause a short circuit between earphones and the power banks when charging the earphones, which affects the normal operation of the earphones and shortens the service life of products.

BRIEF SUMMARY OF THE INVENTION

Aiming at the defects in the prior art, the technical problem to be solved by the utility model is to provide a waterproof Bluetooth dual-earphone power bank.

To solve the above technical problems, the utility model employs the following solution. A waterproof Bluetooth dual-earphone power bank includes a mobile power supply body, and also includes a Bluetooth dual-earphone component connected with the mobile power supply body.

The mobile power supply body consists of an inner housing, an outer housing, charging batteries, a foam, a PCB, a pin, a base, a first sealing ring and a rubber pad; the inner housing is a square body, provided with a battery accommodating cavity in the middle and provided with a fastening portion and a waterproof ring slot at the end thereof which is connected to the Bluetooth dual-earphone component; the inner housing is disposed in the outer housing; the charging batteries are installed in the inner housing; the base is L-shaped, and a lateral shield at the bottom of the L-shape is formed with a second U-shaped groove; a first U-shaped groove and the second U-shaped groove are connected to form a labyrinth slot; the PCB is disposed in two shields of the base; the rubber pad is disposed on a front groove face of the base; the rubber pad is fixed by the pin; the rubber pad rotates by taking the pin as the axis; the first sealing ring is sleeved in along the edge of a groove at the outer wall of a front opening portion of the base; the base is inserted into the inner housing such that the base and the inner housing are sealed; and the rubber pad rotates and screws into the front groove of the base such that the front groove face of the base is sealed.

The Bluetooth dual-earphone component consists of two earphones, an earphone bracket, two magnets, two iron plates, two silica gel brackets and two elastic pins; the earphone bracket is provided with two open-ended troughs, and the end face of each one of the open-ended troughs is provided with a dual-round-hole plate; each one of the open-ended troughs is internally provided with three clamping slots which respectively clamp the two round magnets, the two round iron plates and the two round silica gel brackets from the inside to the outside; the two earphones are inserted into the earphone bracket through the dual-round-hole plates such that the two earphones are inserted into the two magnets, the two iron plates and the two silica gel brackets; and the two elastic pins are inserted into round holed grooves of the two silica gel brackets and are connected with tail charging jacks of the two earphones.

The waterproof ring slot of the inner housing is sleeved with a second sealing ring; the Bluetooth dual-earphone component is placed in a upper cover and fastens the upper cover with the inner housing; the upper cover and the inner housing are closed after being fastened; the upper cover is jacketed with an outer cover; and a lens is disposed at the outer end face of the outer cover.

Further, the outer housing is an aluminum housing.

Further, the charging batteries are two cylindrical batteries, and the two cylindrical batteries are jacketed by the foam.

Further, an iron rod vertical to the iron plate surface is disposed at the edge of the corresponding one of the two iron plates, and the iron rods are disposed in the inner grooves of the two silica gel brackets.

Further, the lens is an acrylic lens.

Further, a plurality of jacks are formed on the outer groove face of the base, and various data cable interfaces of the PCB are placed in the jacks.

Further, a ring-shaped gear slot is disposed on the lateral wall of an end portion of the pin, and a column portion of the pin is inserted via the groove at a lateral edge of the base.

Further, the outer cover is an aluminum outer cover.

Compared with the prior art, the utility model has the following beneficial effects. The power bank of the utility model is fastened up and down through two sealing rings such that the inner housing is sealed and bonded with the upper cover and that the rubber pad is sealed and bonded with the base, thus fulfilling the waterproofing purpose by extruding the sealing rings. The power bank of the utility model achieves a stable and reliable waterproof effect and ensures stable charging and service life of the product. The power bank of the utility model is wrapped with a metal housing outside, achieving anti-collision and anti-scratching effects; and the hand feel is strengthened through surface sanding and oxidation treatment.

DETAILED DESCRIPTION OF THE INVENTION

The preferable embodiments are described in detail with reference to the attached drawings such that those skilled in this field can more easily understand the advantages and characteristics of the utility model to more clearly define the protective scope of the utility model.

Figure 1:
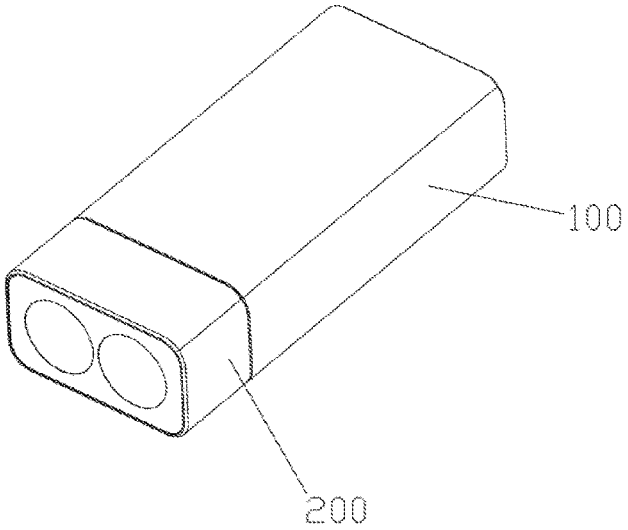
FIG. 1 is a space diagram of the appearance of a power bank of the utility model.
Figure 2:
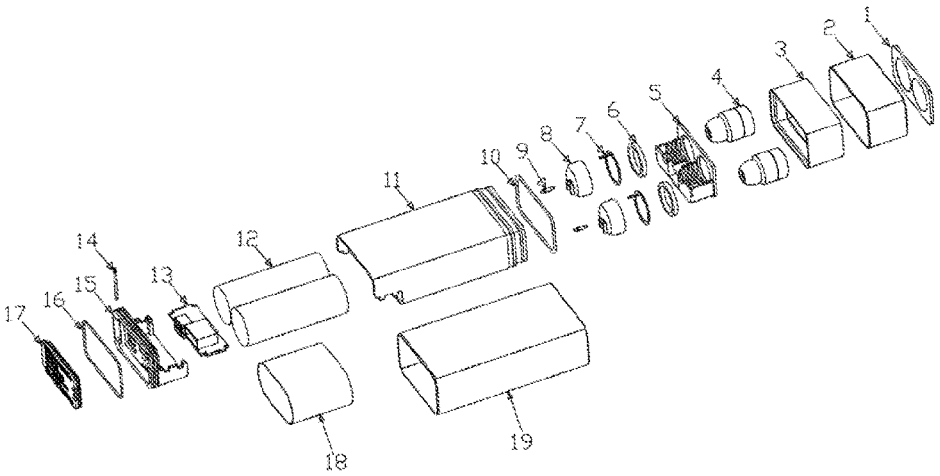
FIG. 2 is an exploded view of the power bank of the utility model.
Figure 3:
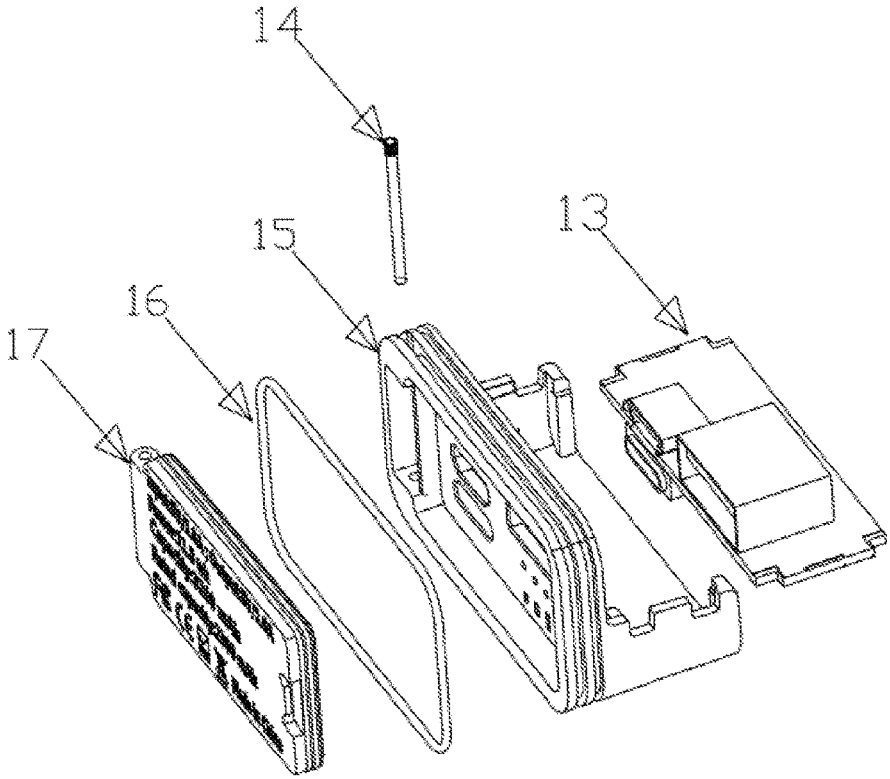
FIG. 3 is an exploded view of a charging/discharging end of a mobile power supply body of the utility model.
Figure 4:
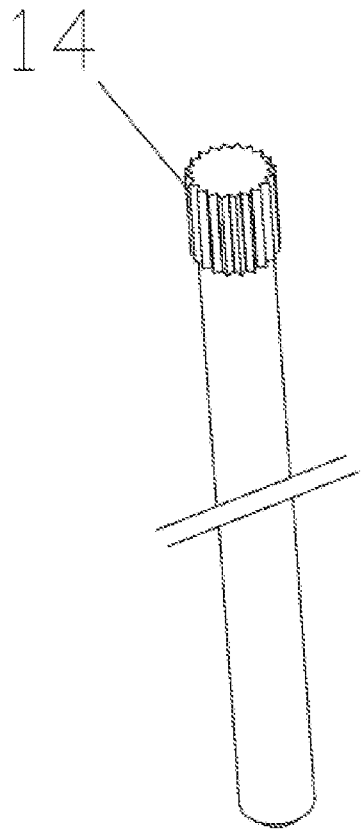
FIG. 4 is a structural view of a pin of the utility model.
Figure 5:
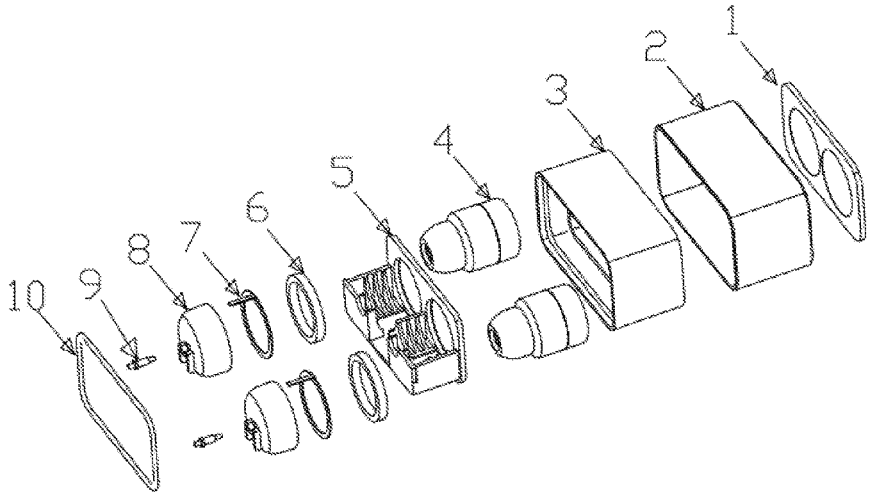
FIG. 5 is an exploded view of a Bluetooth dual-earphone component of the utility model.

Refer to FIGS. 1-5. A waterproof Bluetooth dual-earphone power bank of the utility model includes a mobile power supply body 100 and also includes a Bluetooth dual-earphone component 200 connected with the mobile power supply body 100.

The mobile power supply body 100 consists of an inner housing 11, an outer housing 19, charging batteries 12, a foam 18, a PCB 13, a pin 14, a base 15, a first sealing ring 16 and a rubber pad 17; the inner housing 11 is a square body, provided with a battery accommodating cavity in the middle and provided with a fastening portion and a waterproof ring slot at the end thereof which is connected to the Bluetooth dual-earphone component 200; the inner housing 11 is disposed in the outer housing 19; the charging batteries 12 are installed in the inner housing 11; the base 15 is L-shaped, and a lateral shield at the bottom of the L-shape is formed with a second U-shaped groove; a first U-shaped groove and the second U-shaped groove are connected to form a labyrinth slot; the PCB 13 is disposed in two shields of the base 15; the rubber pad 17 is disposed on a front groove face of the base 15; the rubber pad 17 is fixed by the pin 14; the rubber pad 17 rotates by taking the pin 14 as the axis; the first sealing ring 16 is sleeved in along the edge of a groove at the outer wall of a front opening portion of the base; the base is inserted into the inner housing such that the base and the inner housing are sealed; and the rubber pad 17 rotates and screws into the front groove of the base such that the front groove face of the base is sealed.

The Bluetooth dual-earphone component 200 consists of two earphones 4, an earphone bracket 5, two magnets 6, two iron plates 7, two silica gel brackets 8 and two elastic pins 9; the earphone bracket 5 is provided with two open-ended troughs, and the end face of each one of the open-ended troughs is provided with a dual-round-hole plate; each one of the open-ended troughs is internally provided with three clamping slots which respectively clamp the two round magnets 6, the two round iron plates 7 and the two round silica gel brackets 8 from the inside to the outside; the two earphones 4 are inserted into the earphone bracket 5 through the dual-round-hole plates such that the two earphones are inserted into the two magnets 6, the two iron plates 7 and the two silica gel brackets 8; and the two elastic pins 9 are inserted into round holed grooves of the two silica gel brackets 8 and are connected with tail charging jacks of the two earphones 4.

The waterproof ring slot of the inner housing 11 is sleeved with a second sealing ring 10; the Bluetooth dual-earphone component 200 is placed in a upper cover 3 and fastens the upper cover 3 with the inner housing 11; the upper cover 3 and the inner housing 11 are closed after being fastened; the upper cover 3 is jacketed with an outer cover 2; a lens 1 is disposed at the outer end face of the outer cover 2, and the lens 1 is an acrylic lens.

The outer housing 19 is an aluminum housing. The outer cover 2 is an aluminum outer cover. The surfaces of the outer housing 19 and the outer cover 2 both undergo sanding and oxidation treatment, so the power bank has a better hand feel.

The charging batteries 12 are two cylindrical batteries, and the two cylindrical batteries are jacketed by the foam 18, thus protecting the charging batteries and providing the charging batteries with an anti-collision capability.

An iron rod vertical to the iron plate surface is disposed at the edge of the corresponding one of the two iron plates 7, and the iron rods are disposed in the inner grooves of the two silica gel brackets 8.

A plurality of jacks are formed on the outer groove face of the base 15, and various data cable interfaces of the PCB 13 are placed in the jacks.

A ring-shaped gear slot is disposed on the lateral wall of an end portion of the pin 14, and a column portion of the pin 14 is inserted via the groove at a lateral edge of the base 15. The gear slot is fixed to prevent the pin from falling down.

The two earphones of the utility model are Bluetooth earphones which are built-in with charging batteries, and the elastic pins are connected with the tails of the two earphones, so the mobile power supply body can charge the two earphones. The power bank of the utility model is fastened up and down through two sealing rings such that the inner housing is sealed and bonded with the upper cover and that the rubber pad is sealed and bonded with the base, thus fulfilling the waterproofing purpose by extruding the sealing rings. The power bank of the utility model achieves a stable and reliable waterproof effect and ensures stable charging and service life of the product. The power bank of the utility model is wrapped with a metal housing outside, achieving the anti-collision and anti-scratching effects; and the hand feel is strengthened through surface sanding and oxidation treatment.

The above are only some preferable embodiments of the utility model and shall not be regarded as limits to the utility model. Any equivalent structure or equivalent flow modifications made on the basis of the description and attached drawings of the utility model, or director or indirect application to other related fields, shall fall within the protective scope of the utility model.

What is claimed is:

1. A waterproof Bluetooth dual-earphone power bank, comprising a mobile power supply body (100), characterized by also comprising a Bluetooth dual-earphone component (200) connected with the mobile power supply body (100);

wherein the mobile power supply body (100) consists of an inner housing (11), an outer housing (19), charging batteries (12), a foam (18), a PCB (13), a pin (14), a base (15), a first sealing ring (16) and a rubber pad (17); the inner housing (11) is a square body, provided with a battery accommodating cavity in the middle and provided with a fastening portion and a waterproof ring slot at the end thereof which is connected to the Bluetooth dual-earphone component (200); the inner housing (11) is disposed in the outer housing (19); the charging batteries (12) are installed in the inner housing (11); the base (15) is L-shaped, and a lateral shield at the bottom of the L-shape is formed with a second U-shaped groove; a first U-shaped groove and the second U-shaped groove are connected to form a labyrinth slot; the PCB (13) is disposed in two shields of the base (15); the rubber pad (17) is disposed on a front groove face of the base (15); the rubber pad (17) is fixed by the pin (14); the rubber pad (17) rotates by taking the pin (14) as the axis; the first sealing ring (16) is sleeved in along the edge of a groove at the outer wall of a front opening portion of the base; the base is inserted into the inner housing such that the base and the inner housing are sealed; the rubber pad (17) rotates and screws into the front groove of the base such that the front groove face of the base is sealed;

wherein the Bluetooth dual-earphone component (200) consists of two earphones (4), an earphone bracket (5), two magnets (6), two iron plates (7), two silica gel brackets (8) and two elastic pins (9); the earphone bracket (5) is provided with two open-ended troughs, and the end face of each one of the open-ended troughs is provided with a dual-round-hole plate; each one of the open-ended troughs is internally provided with three clamping slots which respectively clamp the two round magnets (6), the two round iron plates (7) and the two round silica gel brackets (8) from the inside to the outside; the two earphones (4) are inserted into the earphone bracket (5) through the dual-round-hole plates such that the two earphones are inserted into the two magnets (6), the two iron plates (7) and the two silica gel brackets (8); the two elastic pins (9) are inserted into round holed grooves of the two silica gel brackets (8) and are connected with tail charging jacks of the two earphones (4);

wherein the waterproof ring slot of the inner housing (11) is sleeved with a second sealing ring (10); the Bluetooth dual-earphone component (200) is placed in a upper cover (3) and fastens the upper cover (3) with the inner housing (11); the upper cover (3) and the inner housing (11) are closed after being fastened; the upper cover (3) is jacketed with an outer cover (2); and a lens (1) is disposed at the outer end face of the outer cover (2).

2. The waterproof Bluetooth dual-earphone power bank according to claim 1, characterized in that the outer housing (19) is an aluminum housing.

3. The waterproof Bluetooth dual-earphone power bank according to claim 1, characterized in that the charging batteries (12) are two cylindrical batteries, and the two cylindrical batteries are jacketed by the foam (18).

4. The waterproof Bluetooth dual-earphone power bank according to claim 1, characterized in that an iron rod vertical to the iron plate surface is disposed at the edge of the corresponding one of the two iron plates (7), and the iron rods are disposed in the inner grooves of the two silica gel brackets (8).

5. The waterproof Bluetooth dual-earphone power bank according to claim 1, characterized in that the lens (1) is an acrylic lens.

6. The waterproof Bluetooth dual-earphone power bank according to claim 1, characterized in that a plurality of jacks are formed on the outer groove face of the base (15), and various data cable interfaces of the PCB (13) are placed in the jacks.

7. The waterproof Bluetooth dual-earphone power bank according to claim 1, characterized in that a ring-shaped gear slot is disposed on the lateral wall of an end portion of the pin (14), and a column portion of the pin (14) is inserted via the groove at a lateral edge of the base (15).

8. The waterproof Bluetooth dual-earphone power bank according to claim 1, characterized in that the outer cover (2) is an aluminum outer cover.

* * * * *